United States Patent [19]

Koizumi

[11] Patent Number: 4,505,577

[45] Date of Patent: Mar. 19, 1985

[54] TONER POWDER COLLECTION DEVICE

[75] Inventor: Yutaka Koizumi, Kawasaki, Japan

[73] Assignee: Ricoh Company, Ltd., Japan

[21] Appl. No.: 474,551

[22] Filed: Mar. 11, 1983

[30] Foreign Application Priority Data

| | | | |
|---|---|---|---|
| Mar. 15, 1982 | [JP] | Japan | 57-40458 |
| Apr. 7, 1982 | [JP] | Japan | 57-57664 |
| May 13, 1982 | [JP] | Japan | 57-80746 |

[51] Int. Cl.[3] ..... G03G 15/08

[52] U.S. Cl. ..... 355/15

[58] Field of Search ..... 355/300, 140, 15; 430/125; 118/652; 361/233, 227

[56] References Cited

U.S. PATENT DOCUMENTS

| | | | |
|---|---|---|---|
| 4,101,215 | 7/1978 | Fottner et al. | 355/15 |
| 4,108,546 | 8/1978 | Rezanka | 355/15 |
| 4,260,243 | 4/1981 | Dolan et al. | 355/15 |
| 4,323,306 | 4/1982 | Ito et al. | 355/15 |
| 4,395,114 | 7/1983 | Ura et al. | 355/15 |
| 4,423,950 | 1/1984 | Sagami | 355/15 |

*Primary Examiner*—A. C. Prescott

*Attorney, Agent, or Firm*—Guy W. Shoup

[57] ABSTRACT

A toner powder collection device suitable for use in an electrophotographic copying machine and the like includes a transporting member such as a transporting trough defining a transporting path along which the toner powder is transported and an oscillating device for preferentially oscillating the transporting member such that the toner effectively moves along the transporting path.

14 Claims, 10 Drawing Figures

TONER POWDER COLLECTION DEVICE

BACKGROUND OF THE INVENTION

1. Field of the Invention

This invention generally relates to a powder collection device, and, in particular, to a device for collecting toner powder which is to used for developing an elastrostatic latent image and remaining on an image forming surface. More particularly, the present invention relates to a toner powder collection device for collecting toner powder from the surface of an image forming member such as a photosensitive member to be used in an electrophototgraphic copying machine and the like.

2. Description of the Prior Art

In electrostatography including electrostatic recording and electrophotographic copying technologies, various cleaning means have been used for removing the toner powder remaining on the surface of an image forming member, on which an electrostatic latent image is formed and developed by toner powder, after transfer of the deveoped image to a transfer medium such as paper. Although blade cleaners do have some disadvantages such that a surface to be cleaned and a blade to scrub the surface to be cleaned are easily worn out, they are presently widely used because of their stability and reliability in cleaning operation. In a blade cleaning system, the toner particles removed from the surface to be cleaned may be stuck between the cleaning blade and the surface or they may be deposited onto the blade thereby lowering the cleaning performance. In order to avoid such a disadvantage, various proposals have been made for collecting the toner particles removed from the surface to be cleaned by a blade.

FIG. 1 shows a prior art cleaning system using a cleaning blade for toner removal from an image forming surface. As shown, a cleaning blade 1 is disposed with its leading edge in scrubbing contact with the surface of a photosensitive drum 2, which is driven to rotate in the counterclockwise direction, at the location where the moving direction of the drum surface is pointed generally vertically upward. Thus the toner particles remaining on the drum surface are removed from the drum surface by the blade 1 and fall to the bottom of a casing 3. A toner powder transporting member 4 such as a rotating coil is disposed at the bottom of the casing 3 so that the toner powder is transported to a desired position by the transporting member 4. FIG. 2 shows another prior art cleaning system in which the photosensitive drum 2 is driven to rotate in the clockwise direction and a cleaning blade 5 is so disposed that its leading edge is in scrubbing contact with the surface of the drum 2 at the location where the moving direction of the drum surface is pointed generally vertically downward. Thus, the toner particles removed from the drum surface by the blade 5 slide down the top surface of the blade 5 and then they are collected into the casing 3. Similarly with the previous case, the rotating coil 4 is provided at the bottom of the casing 3 so that the collected toner particles may be transported to a desired location.

In a prior art toner powder collection system as described above, the toner particles may receive unacceptable mechanical stress thereby causing changes in mechanical properties; moreover, a cavity may be created in the toner powder collected in the casing 3 thereby causing no toner particles to be transported by the rotating coil 4.

SUMMARY OF THE INVENTION

The disadvantages of the prior art are overcome with the present invention and an improved powder collection technology is presented. In accordance with one aspect of the present invention, there is provided a toner powder collection device which includes a transport member for transporting toner powder in a predetermined direction and oscillating means for oscillating the transport member such that the acceleration in moving the transport member in the predetermined direction is larger than the acceleration in moving the transport member in the direction opposite to the predetermined direction thereby causing the toner powder riding on the transport member to move as a net in the predetermined direction. Such a structure is advantageous because unacceptable mechanical stress is prevented from being applied to the transporting toner particles and yet a toner powder transport efficieny is high. Furthermore, the structure is rather simple, compact in size and easy to make.

Therefore, it is a primary object of the present invention to provide a powder collection device capable of transporting powder to be collected to a desired place without causing mechanical damages to the powder to be transported.

Another object of the present invention is to provide a toner powder collection device which is high in transport and thus collection efficiencies.

A further object of the present invention is to provide a toner powder collection device which is suitable for use in transporting the toner powder removed from an image forming surface to be collected into a desired place.

A still further object of the present invention is to provide a toner powder collection device for collecting the toner particles removed from the surface of a photosensitive member as remaining thereon after transfer to a desired location, for example, for reuse.

A still further object of the present invention is to provide a toner powder collection device which is simple in structure and thus easy to make as well as low at manufacturing cost.

A still further object of the present invention is to provide a toner collection device which is reliable in collection operation and capable of collecting toner powder without causing scattering of toner powder.

Other objects, advantages and novel features of the present invention will become apparent from the following detailed description of the invention when considered in conjunction with the accompanying drawings.

DESCRIPTION OF THE PREFERRED EMBODIMENTS

Figure 1:
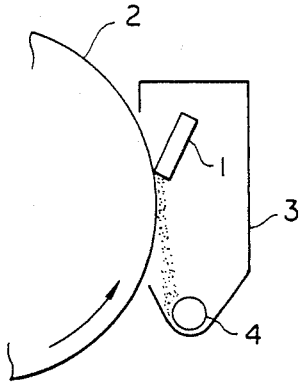
Fig. 1 PRIOR ART
FIG. 1 is a schematic illustration showing a prior art blade cleaning device.
Figure 2:
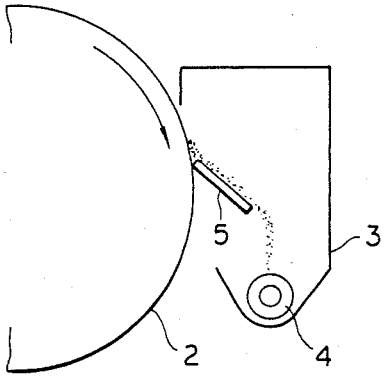
Fig. 2 PRIOR ART
FIG. 2 is a schematic illustration showing another prior art blade cleaning device.
Figure 3:
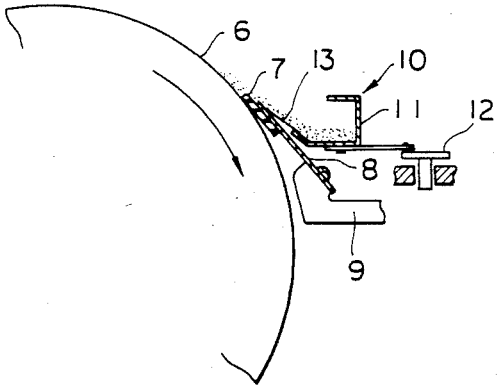
FIGS. 3 and 4 are schematic illustrations each showing an embodiment of the toner powder collection device constructed in accordance with the present invention.

Referring now to FIG. 3, there is shown a toner powder collection device embodying the present invention as applied to an electrophotographic copying machine. As shown, a photosensitive drum 6 having an image forming surface as defined on its peripheral surface is driven to rotate in the clockwise direction as indicated by the arrow. Although not shown specifically, it should be understood that various electrophotographic process devices are disposed around the periphery of the drum 6. For example, charging, image-exposing, developing and transferring devices are disposed in the order mentioned along the rotating direction of the drum 6. Thus, as the drum 6 rotates, its surface is uniformly charged and the charge is selectively dissipated by image exposure to form an electrostatic latent image, which is then developed by toner powder thereby forming a visual toner image. The thus formed toner image is transferred to transfer paper by any well known transfer method. After transfer, on the image forming surface of the drum 6 remains non-transferred toner powder. Thus, the residual toner powder must be removed before presenting the drum surface for the next cycle of image forming operation.

In the structure shown in FIG. 3, a cleaning blade 7 is provided for the purpose of removing the residual toner powder from the surface of the drum 6. The blade 7 is so disposed that its leading edge is pressed against the surface of the drum 6 as pointed in the direction counter or opposite to the moving direction of the drum surface at the contact therebetween, which is normally called the counter blade system. The blade 7 is formed by an elastic material such as polyurethane rubber. The blade 7 is supported on a blade holder 8, which, in turn, is detachably mounted on a support 9 by means of screws or the like. Since the top surfaces of the blade 7 and the holder 8 are inclined downwardly to the right, the residual toner powder removed by the blade 7 from the peripheral surface of the drum 6 moves along the blade 7 and the holder 8.

A toner powder collection device 10 is disposed to the right of the blade 7. The collection device 10 includes a toner powder transporting trough 11 which is caused to oscillate preferentially in direction so as to transport the toner powder received therein in a desired direction by means of an oscillating device 12, which is operatively connected to the transporting trough 11. Stated more in detail, in one example, the trough 11 is set in oscillation in the longitudinal direction thereof such that the acceleration in moving the trough 11 in a predetermined or toner powder transporting direction is larger than the acceleration in moving the trough 11 in the direction opposite to the predetermined direction or returning direction. With such a structure, the toner powder received in the trough 11 is forced to move in the toner transporting direction because the toner powder receive a stronger acceleration in that direction. An excellent transport of toner powder along the trough 11 has been obtained with the oscillation having the amplitude of 2mm and the frequency of 20–50 Hz.

A flexible guide blade 13, for example of Mylar, is provided as bridging between the blade holder 8 and the trough 11 so as to smoothly transfer the toner powder from the blade holder 8 to the trough 11. In one example, one end of the guide blade 13 may be fixedly attached to the blade holder 8 with the opposite end freely riding on the entrance section of the trough 11. On the other hand, one end of the guide blade 13 may be fixedly attached to the trough 11 with the opposite end defining a free and resting on the top surface of the blade holder 8, and, in this case, the guide blade 13 is set in oscillation together with the trough 11. As a result, the toner powder riding on the blade holder 8 is scraped off by the guide blade 13 to be received into the trough 11. It is to be noted that since the free end of the guide blade 13 slidingly moves on the top surface of the holder 8 with keeping in intimate contact therewith, there is no danger of having the toner powder scattered or leaked to the exterior even if the trough 11 is set in oscillation. In this manner, the toner powder thus received in the trough 11 is caused to move in a desired transporting direction along the trough 11 to be collected into a toner powder collection container, and, if necessary, it is again presented for use.

Figure 4:
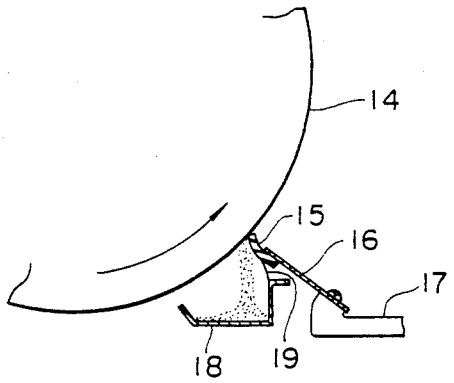

FIG. 4 shows another embodiment of the toner powder collection device used in an electrophotographic copying machine whose photosensitive drum 14 is driven to rotate in the counterclockwise direction as indicated by the arrow. Similarly with the embodiment shown in FIG. 3, the toner powder remaining on the peripheral surface of the drum 14 after transfer is removed by a cleaning blade 15. However, the cleaning blade 15 of this embodiment is disposed such that its forward or free end is in pressure contact with and at the bottom half of the peripheral surface of the drum 14 and the forward end is generally pointed in the direction of movement of the drum surface at the contact therebetween. This form of blade cleaner is commonly called the trailing blade cleaning system. The blade 15 is fixedly attached at its base end section to a blade holder 16, which, in turn, is detachably mounted on a support 17 by means of screws and the like. As shown, the toner powder removed from the drum surface 14 by the cleaner blade 15 fall though some of the removed toner powder will slide along the surface of the blade 15 also downwardly.

A toner powder transporting trough 18 is disposed generally below the cleaner blade 15 so as to receive the falling toner powder as removed by the blade 15. As understood, the toner powder transporting trough 18 must be long enough to receive all of the falling toner particles as removed by the blade 15, so that the trough 18 must be at least as long as the drum 14 or the blade 15. Although not shown specifically in FIG. 4, the trough 18 is set in preferential oscillation by means of an oscillating device as in the embodiment of FIG. 3. Thus the toner received in the trough 18 is forced to move in a predetermined direction to be collected at a desired place. A flexible guide blade 19 of Mylar or the like is provided with its one end fixedly attached to the trough so that the blade 19 is set in oscillation together with the trough 18. The free or top end of the guide blade 19 is elastically pressed against the surface of the cleaner blade 15, and, therefore, even if the guide blade 19 in set in vibration, no gap will be formed between the cleaner and guide blades 15 and 19 thereby allowing to securely collect the toner particles removed from the drum surface.

Figure 5:
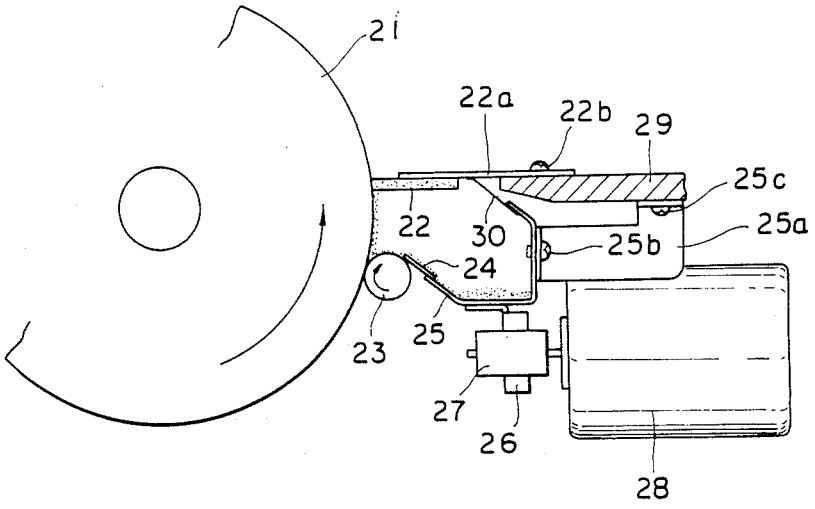
FIG. 5 is a schematic illustration showing another embodiment of the toner powder collection device having the shield roller 23 constructed in accordance with the present invention.

Referring now to FIG. 5, there is shown a further embodiment of the present toner powder collection device. As shown, a photosensitive member 21 constructed in the form of a drum is driven to rotate in the counterclockwise direction as indicated by the arrow, and the toner powder remaining on the peripheral surface of the drum 21 after toner image transfer operation is to be removed and collected to a desired location. A cleaner blade 22 is so provided to be normal to the peripheral surface of the drum 21 with its free end in pressure contact therewith. As in the previous cases, the cleaner blade 22 is formed by an elastic material such as polyurethane rubber. The base end of the blade 22 is fixedly attached to a blade holder 22*a*, which, in turn, is fixed to a support 29 by means of fixing means 22*b*. Thus the residual toner powder remaining on the peripheral surface of the drum 21 is scaped off by the blade 22.

Disposed below the cleaner blade 22 and in contact with the peripheral surface of the drum 21 is a shield roller 23 which is driven to rotate in the clockwise direction as indicated by the arrow. The shield roller 23 may, for example, be comprised of a metal core roller and an elastic material layer formed on the peripheral surface of the metal core roller. The shield roller 23 is preferably driven to rotate with the same peripheral speed with the drum 21, and it functions to transport the toner powder falling from the surface of the drum 21 as scraped off by the cleaner blade 22.

Also provided is a second blade 24 having its free end in pressure contact with the peripheral surface of the shield roller 23 for removing the toner powder on the peripheral surface of the shield roller 23 and leading the thus removed toner powder to a trough 25 to which the base end of the second blade 24 is fixedly connected. The trough 25 is a transporting member for receiving the toner powder removed from the surface of the drum 21 and transporting it along a predetermined direction to be collected into a desired location. The second blade 24 is made of an elastic material such as a Mylar film. The transporting trough 25 is fixedly mounted on a holder member 25*a* by means of a fixing means 25*b*; on the other hand, the holder member 25*a* is fixedly mounted on a support 29 through another fixing means 25*c*.

The support 29 may, for example, be comprised of a stainless steel plate of 0.1 mm thick, and when so structured, the trough 25 may be set in oscillation in the direction generally in parallel with the rotating axis of the drum 21, or in the direction perpendicular to the plane of the drawings. Also provided is a shield film 30, for example, of Mylar film, having its bottom end fixedly connected to the trough 25 and its top and free end resiliently pressed against the bottom surface of the holder plate 22*a*. In this manner, a closed chamber is defined by a part of the peripheral surface of the drum 21, shield roller 23, blade 24, trough 25, shield film 30, holder plate 22*a* and blade 22.

Figure 6:
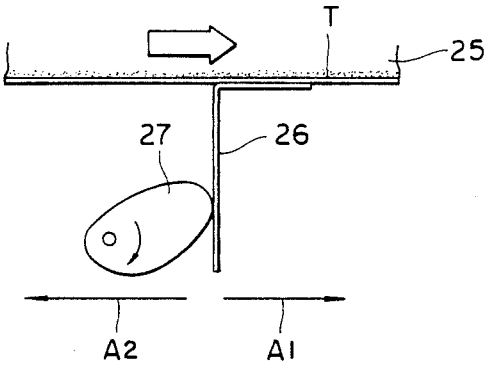
FIG. 6 is a schematic illustration showing one example of the oscillating mechanism to be applicable for the present toner powder collection device.

A cam follower plate 26 is fixedly mounted at the bottom surface of the trough 25, and a suitably profiled cam 27 is fixedly mounted on the rotating shaft of a motor 28 in operative association with the cam follower plate 26. The engagement between the cam follower plate 26 and the cam 27 is maintained by the springy force of the holder plate 25*a*. FIG. 6 shows an example of the profile of the cam 27, and when the cam 27 is caused to rotate clockwise as indicated by the arrow, the trough 25 is set in oscillation through the cam follower plate 26. It is to be noted that the cam 27 is so profiled that the trough 25 receives a smaller acceleration $A_1$ when the trough 25 moves to the right in FIG. 6; whereas, it receives a larger acceleration $A_2$ when it moves to the left. Under the circumstances, when the trough 25 moves to the right, the toner powder T received in the trough 25 maintains its position and moves together with the trough 11; on the other hand, when the trough 25 moves to the left at acceleration $A_2$, there is produced a slippage between the toner powder T and the trough 25 because the trough 25 moves at a faster speed, whereby the trough 25 moves more to the left as compared with the toner powder T received therein so that the toner powder T is caused to move to the right with respect to the trough 25. Accordingly, by setting the trough 25 in such an oscillating motion, the toner powder T is transported to the right .

Figure 7:
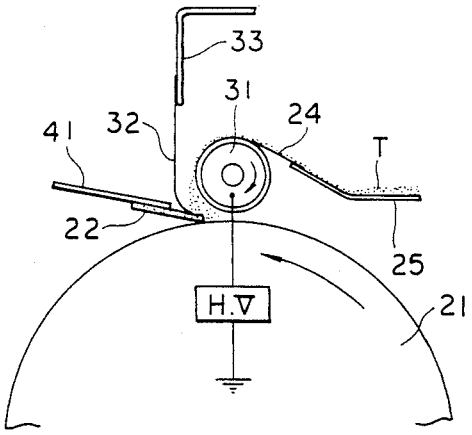
FIG. 7 is a schematic illustration showing a further embodiment of the present toner powder collection device.

FIG. 7 shows a modification of the structure shown in FIG. 5, and, in this case, the cleaner blade 22 is so disposed as supported by a blade holder 41 that its free end is in pressure contact with and directed in opposite to the moving direction of the drum surface at the contact point. Also provided is a collection roller 31 disposed above the drum 21 with a gap therebetween and driven to rotate clockwise as indicated by the arrow. A high voltage is applied to the collection roller 31 by a high voltage source H.V. A shield plate 32 is provided as hanging from a support member 33 with its bottom end in contact with the top surface of the cleaner blade 22. With this structure, the toner powder remaining on the surface of the drum 21 after transfer is scraped off by the cleaner blade 22, and the thus scraped off toner powder is then collected onto the collection roller 31. The toner powder on the collection roller 31 is then fed into the trough 25 as scraped by the blade 24. It should be understood that the trough 25 of FIG. 7 is also set in the oscillating motion as in the above-described embodiment of FIG. 5 so that the toner powder fed into the trough 25 is caused to move in a predetermined direction. It is to be noted that a thin dielectric layer may be provided on the peripheral surface of the collection roller 31, and, furthermore, the collection roller 31 may be disposed to be in contact with the drum 21 depending upon the properties of the toner powder.

Figure 8:
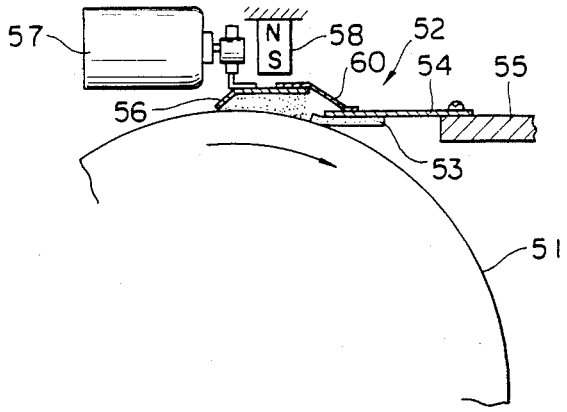
FIGS. 8–10 are schematic illustrations showing still further embodiments of the present toner powder collection device in which use is made of magnetic toner powder.
Figure 9:
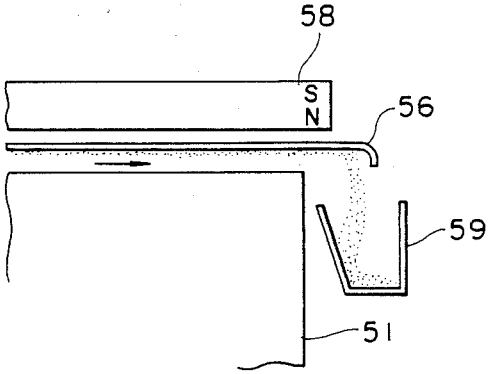
Figure 10:
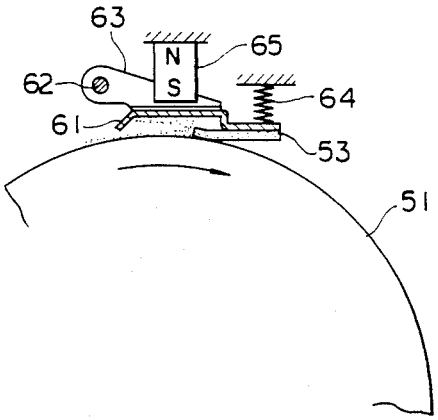

FIGS. 8 through 10 show several embodiments of the toner powder collection device constructed in accordance with the present invention particularly suited for use with magnetic powder such as magnetic toner powder. In FIG. 8, a photosensitive drum 51 is driven to rotate clockwise as indicated by the arrow. The present cleaning or toner powder collection device 52 is disposed generally above the drum 51 and it has a cleaning blade 53 disposed in the counter arrangement as described with respect to the previous examples. Thus the blade 53 has its free end pressed against the surface of drum 51 and its base end porton fixedly attached to a blade holder 54, which, in turn, is securely connected to a support 55 such as a part of the housing of the copying machine. A toner powder transporting tray 56 is disposed generally above the contact line between the drum 51 and the blade 53 and at a distance not so separated away from the drum surface and/or the contact line. Preferably, the tray 56 is formed by a non-magnetic material and it extends generally in parallel with the blade 53. The tray 56 is connected to an oscillating means 57 which imparts a predetermined preferential oscillation to the tray 56 so as to move the toner particles in a desired direction along the bottom surface of the tray 56.

Disposed above the tray 56 is a magnet 58 as a means for producing an attractive magnetic field. Thus, when the magnetic toner powder remaining on the drum 51 is scaped off by the scraper blade 53, the toner powder is magnetically attracted to the bottom surface of the tray 56 because the electrostatic attractive force acting thus far on the remaining magnetic toner powder is relieved when the toner powder is scraped off the drum surface. Under the condition, since the tray 56 is in a preferential oscillation as driven by the oscillating means 57, the magnetic toner powder attracted onto the bottom surface of the tray 56 is caused to move in a desired direction. It is to be noted that the magnetic field strength at the bottom surface of the tray 56 must be so adjusted that it is strong enough to keep the magnetic toner powder attracted to the tray 56 even when the tray 56 is set in oscillation, but it is weak enough to allow the magnetic toner powder attracted to the tray 56 to move in the desired direction when the tray 56 is moved at an increased acceleration.

As shown in FIG. 9, one end of the tray 56 extends sufficiently long beyond the corresponding end of the drum 51; however, the corresponding end of the magnet 58 is terminated short of the tray 56. With this structure, the strength of the magnetic field at the far end portion of the tray 56 becomes sufficiently weak, and, thus, when the magnetic toner powder transported along the tray 56 reaches this section, it falls off the tray 56 to be collected into a toner powder collection container 59. Instead of the container 59, another transporting path leading to the developing station may be positioned thereby allowing to reuse the collected toner powder. In the embodiment shown in FIG. 9, the tip end of the tray is bent downward, which helps prevent the toner powder from being scattered around.

Returning to FIG. 8, a shield member 60 of a flexible material such as a Mylar film is provided as bridging between the tray 56 and the blade 53 or the holder 54. For example, the shield member 60 may be fixedly attached to the tray 56 so as to be set in oscillation together with the tray 56. In this case, the other end of the shield member 60 is made to rest freely on the blade 53 or holder 54.

FIG. 10 shows another embodiment of the present magnetic toner powder collection device, and, in this embodiment, the cleaning blade 53 and the transporting tray 61 are constructed as a unit. As shown, the tray 61 is fixedly mounted on a support 63 which is pivotally supported by a shaft 62 extending in parallel with the rotating axis of the drum 51. The support 63 is operatively associated with an oscillating means (not shown), and, thus, the support 63 and thus the tray 61 are set in oscillating motion in the longitudinal direction of the shaft 62. It is true that such an oscillation is a preferential oscillation as described previously. A spring 64 is provided to cause the support 63 rotate around the shaft 62 so that the blade 53 is pressed against the peripheral surface of the drum 51. Also provided is a magnet 65 as a means for attracting the magnetic toner powder toward the tray 61. In this structure, since the blade 53 is integraly formed with the tray 61, there is less chance of escape of toner powder, and, for this reason, it is not necessary to provide a shield member, as in the previous embodiment. In addition, the blade 53 is also set in oscillation in the embodiment of FIG. 10, and this is advantageous because the cleaning efficiency may be increased and the level of pressure contact with the drum surface may be decreased.

While the above provides a full and complete disclosure of the preferred embodiment of the present invention, various modifications, alternate constructions and equivalents may be employed without departing from the true spirit and scope of the invention. For example, the present invention may be applied to any image forming surface including a dielectric recording member and it should not be limited to a photosensitive member as described in detail above as an example. It should also be noted that an oscillating means applicable to the present invention is not limited to a motor and cam combination and various other combinations or structures may be taken by those skilled in the art within the spirit and scope of the present invention. For example, any machanical (such as using a ratchet wheel) and electromagnetic means may be used to obtain a desired oscillation. Furthermore, the transporting surface of the trough or tray for transporting powder thereon may be processed desireably to give a required roughness or friction to the powder to be transported. For example, the transporting surface may be made irregular with ups and downs, or, alternatively, the width of the transporting channel formed in the trough or tray may be varied periodically or irregularly. Besides, the trough or tary may be disposed at an angle with respect to the transporting direction of powder, i.e., with respect to the rotating axis of the drum when used in combination with a photosensitive drum as described above. In addition, the powder to be transported should not be limited to toner powder and the present invention may be applied to any powder. Therefore, the above description and illustration should not be construed as limiting the scope of the invention, which is defined by the appended claims.

What is claimed is:

1. A toner powder collection system for collecting the toner powder remaining on and removed from an image forming surface, on which an electrostatic latent image is formed and developed by toner powder, to a desired place, comprising:

transporting means for transporting said toner powder along a predetermined path;

transferring means for transferring said toner powder removed from said image forming surface to said transporting means; and oscillating means for oscillating said transporting means such that said transporting means moves faster when it moves in the transporting direction of said toner powder along said predetermined path thereby causing a substantial slippage between said toner powder and said transporting means to effectively move said toner powder along said predetermined path in the transporting direction.

2. A system of claim 1 wherein said transporting means includes a transporting trough the lengthwise direction of which determines said predetermined path for transporting said toner powder.

3. A system of claim 2 wherein said transferring means includes a cleaner blade whose one end is in scrubbing contact with said image forming surface.

4. A system of claim 3 wherein said transporting trough is so disposed to receive the falling toner powder as removed by said cleaner blade from said image forming surface.

5. A system of claim 3 wherein said transferring means further includes a guide blade for guiding said toner powder removed from said image forming surface by said cleaner blade into said trough.

6. A system of claim 3 wherein said transferring means further includes a roller for receiving the toner powder as removed by said cleaner blade from said image forming surface and transferring to said trough.

7. A system of claim 6 wherein said transferring means further include a guide blade for guiding said toner powder from said roller to said trough.

8. A system of claim 6 wherein said roller is in rolling contact with said image forming surface.

9. A system of claim 6 wherein said roller is separated away from said image forming surface with the application of a predetermined high voltage thereto.

10. A system of claim 1 further including means for causing said toner powder attracted to said transporting means over said predetermined path for transporting said toner powder.

11. A system of claim 10 wherein said transporting means includes a tray having a transporting surface opposite to said image forming surface, said toner powder being transported along said transporting surface.

12. A system of claim 11 wherein said toner powder is magnetic toner powder and said means for causing said toner powder attracted to said transporting means includes a magnet disposed generally in parallel with said transporting tray.

13. A system of claim 12 wherein said tray extends beyond one end of said magnet at the end of said predetermined path for transporting said toner powder whereby the magnetic field is substantially weak at said end of said predetermined path to allow said magnetic toner powder fall off said tray.

14. A system for transporting powder along a transporting path in a predetermined direction to a desired place, comprising:

transporting means including said transporting path;

means for feeding said powder to said transporting means; and oscillating means for oscillating said transporting means along said transporting path such that said transporting means moves at a higher speed when it moves in the direction opposite to the transporting direction thereby causing a substantial slippage between said powder and said transporting means and that said transporting means moves at a lower speed when it moves in the transporting direction thereby preventing the occurrence of a substantial slippage between said powder and said transporting means.

* * * * *